US005679068A

United States Patent [19]

Byers et al.

[11] Patent Number: 5,679,068

[45] Date of Patent: Oct. 21, 1997

[54] SHARPENING AND DEBURRING TOOL WITH UNITARY BLADE GUARD AND HANDLE

[76] Inventors: Gary L. Byers; Timothy W. Byers, both of P.O. Box 550, Whitefish, Mont. 59937

[21] Appl. No.: 586,609

[22] Filed: Jan. 16, 1996

Related U.S. Application Data

[63] Continuation-in-part of Ser. No. 285,706, Aug. 4, 1994, Pat. No. 5,488,885.

[51] Int. Cl.[6] ..... B23F 21/03

[52] U.S. Cl. ..... 451/557; 76/86; 76/88

[58] Field of Search ..... 451/552, 555, 451/556, 557, 558; 76/82, 86, 87, 88, 89

[56] References Cited

U.S. PATENT DOCUMENTS

| | | | |
|---|---|---|---|
| 455,917 | 7/1891 | Blood | 451/558 |
| 3,149,506 | 9/1964 | Heinmiller | 76/86 |
| 4,418,588 | 12/1983 | Byers | 76/88 |
| 4,502,254 | 3/1985 | Carter | 451/555 |
| 4,599,919 | 7/1986 | Fortenberry | 76/86 |
| 4,974,322 | 12/1990 | Butka | 451/557 |
| 5,046,385 | 9/1991 | Cozzini et al. | 76/86 |
| 5,291,805 | 3/1994 | Byers et al. | 76/88 |
| 5,357,717 | 10/1994 | Friel, Jr. et al. | 451/557 |
| 5,404,679 | 4/1995 | Friel, Jr. et al. | 451/557 |
| 5,431,069 | 7/1995 | Davis | 451/557 |
| 5,461,943 | 10/1995 | Munkel | 76/88 |

*Primary Examiner*—James G. Smith
*Assistant Examiner*—Dona C. Edwards
*Attorney, Agent, or Firm*—Harry M. Cross, Jr.

[57] ABSTRACT

A hand-held sharpener tool for a knife or similar implement comprises a unitary body having first and second sections; sharpening elements mounted in the first section; the second section being located rearwardly of the sharpening elements and comprising an elongated handle on an upper side of the body, and an elongated hand guard extending rearwardly of the sharpening elements, the hand and the hand guard forming an elongated ring rearward of the sharpening elements with sufficient space for a user's fingers to extend between the handle and the hand guard. The sharpening elements can be provided to sharpen/deburr either a two-sided blade such as a knife blade or a one-sided blade such as a scissors blade.

8 Claims, 5 Drawing Sheets

FIG. 1
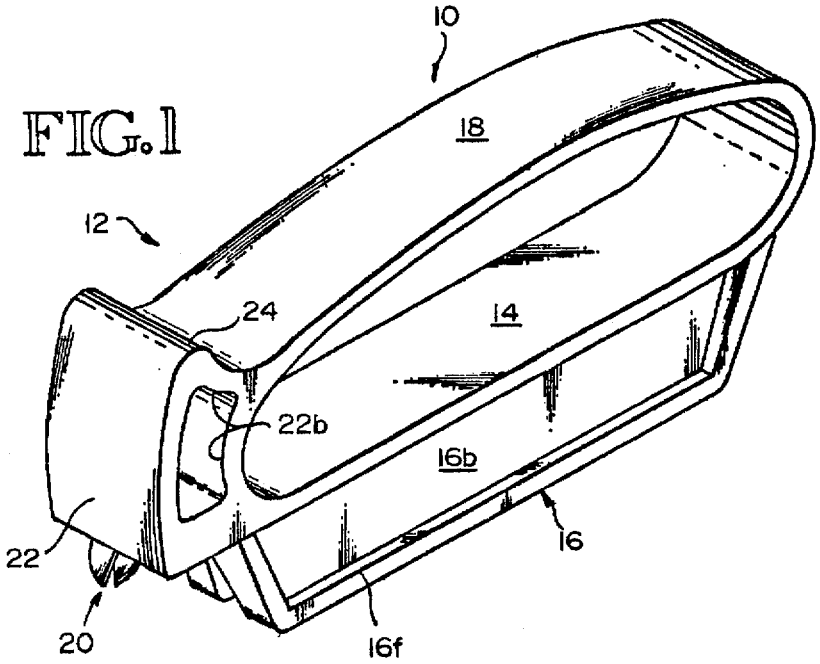
FIG. 2
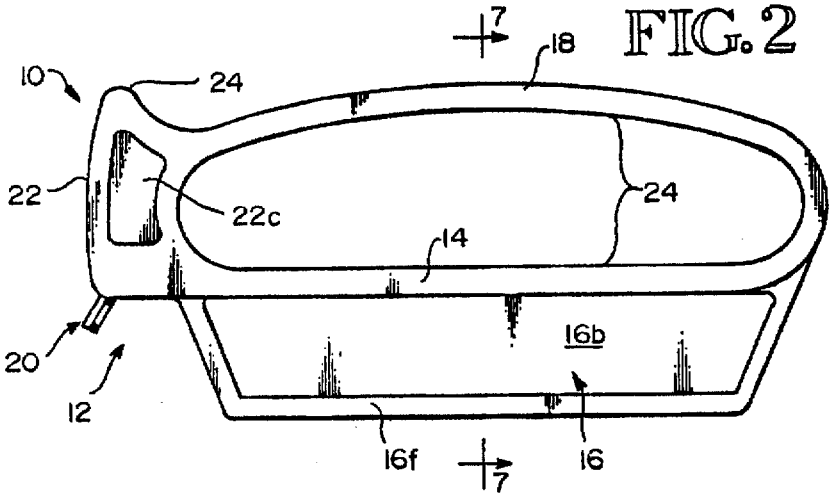
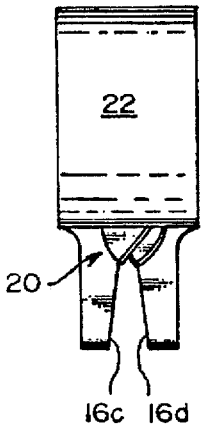
FIG. 3
FIG. 4
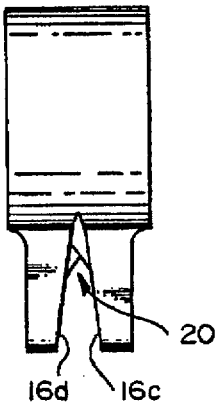

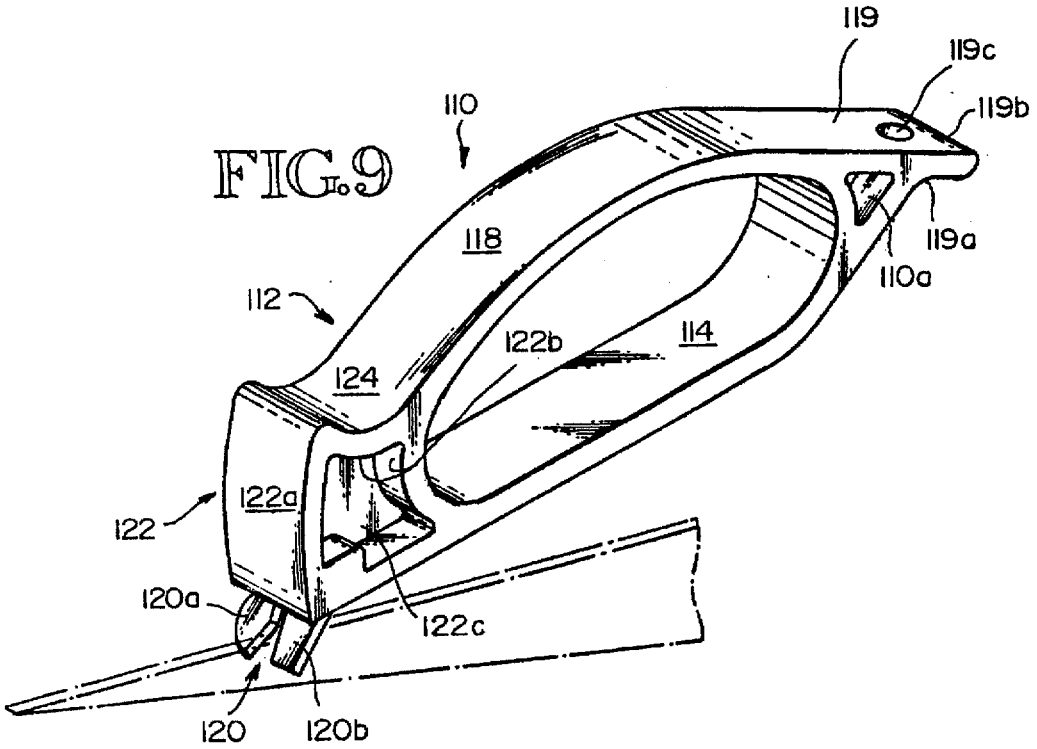
FIG. 9
FIG. 10
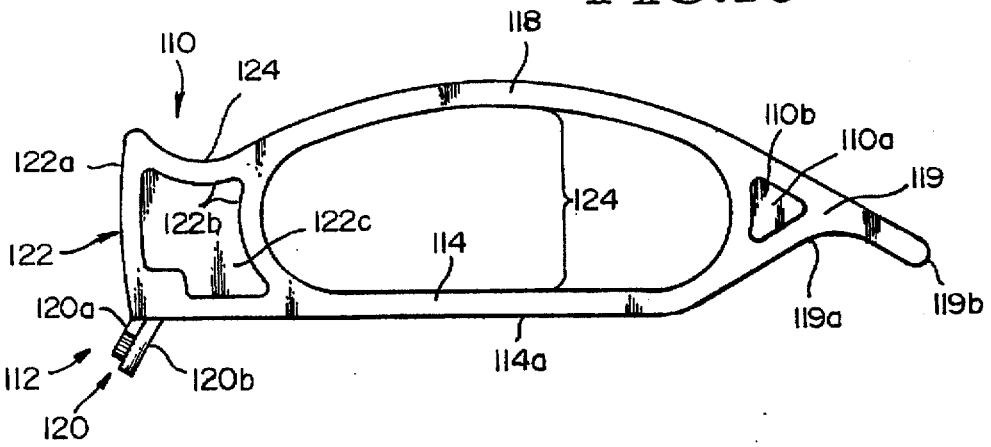
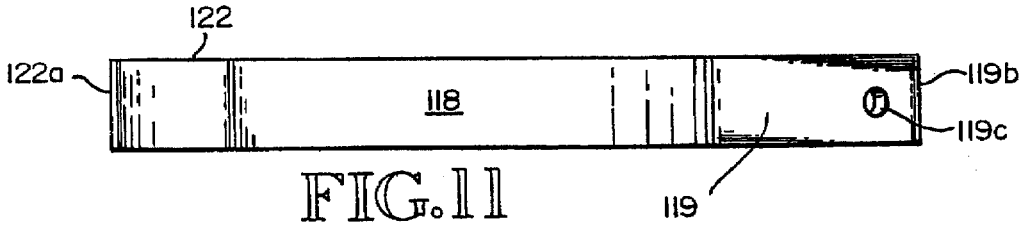
FIG. 11

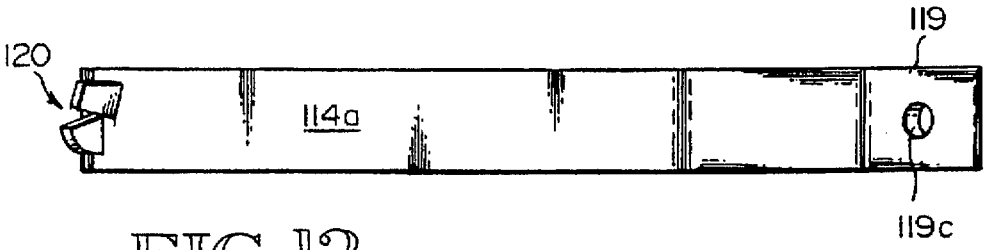
FIG. 12
FIG. 13
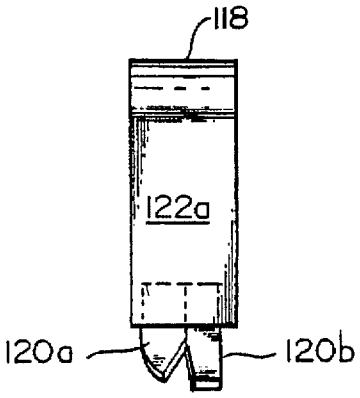
FIG. 14
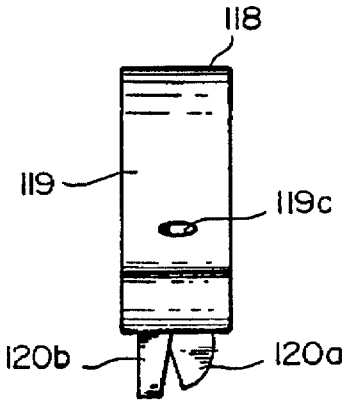

SHARPENING AND DEBURRING TOOL WITH UNITARY BLADE GUARD AND HANDLE

This application is a continuation-in-part of U.S. application Ser. No. 08/285,706, filed Aug. 4, 1994 now U.S. Pat. No. 5,488,885.

FIELD OF THE INVENTION

This invention relates to hand tools and, more particularly, to hand held sharpening and deburring tools.

BACKGROUND OF THE INVENTION

Hand held sharpening and deburring tools have been proposed for home, business, sports, commercial and industrial uses for convergent-edged bladed implements, such as knives, cleavers, hatchets, and the like kind of implements having V-shaped working edges. Hand held tools of this type have been proposed that can accommodate like-structured devices, such as knife-type blades, where sharpening or deburring must occur on two convergent surfaces, and such tools have incorporated hand and finger guards. An exemplary model is disclosed in U.S. Pat. No. 4,418,588 that incorporates a cantilevered guard designed to shield a user's fingers from the blade being sharpened as the tool is drawn along the blade edge. In tools of the type disclosed in U.S. Pat. No. 4,418,588, there is no integrated blade guard that is unitary with the tool handle. This lack of a unitary blade guard and handle causes some user's to be concerned whether they may inadvertently cut themselves when the tool is pulled off the tip of the blade. This concern has resulted in a limiting of the attractiveness of such tools to certain potential users.

SUMMARY OF THE INVENTION

A primary object of the present invention is to provide a hand-held sharpening/deburring tool of the type having a unitary body with a unitary handle and finger/hand guard and that incorporates one or more carbide sharpening/deburring elements.

The hand-held sharpener tool of this invention comprises sharpening means, a body mounting the sharpening means and providing handle means for gripping the tool so as to apply the sharpening means to a blade to be sharpened, and hand guard means for shielding a user's tool-gripping hand, with the hand guard means shielding the user's tool-gripping hand as the tool is drawn along the blade.

BRIEF DESCRIPTION OF THE DRAWINGS

FIG. 1 is a perspective view of one embodiment of the hand held sharpener/deburrer of this invention, this embodiment incorporating an integral blade guide means;

FIG. 2 is a side elevation view of the FIG. 1 tool;

FIG. 3 is a front end view of the FIG. 1 tool further illustrating the placement of two overlapped carbide sharpening/deburring elements;

FIG. 4 is a rear end view of the FIG. 1 tool further illustrating the blade guide notch in relation to the overlapped sharpening/deburring elements;

FIG. 9 is a perspective view of a second embodiment of the hand held sharpener/deburrer of this invention, this embodiment not incorporating a blade guide means but incorporating an integral rear extension;

FIG. 10 is a side elevation view of the FIG. 9 tool;

FIG. 11 is a top plan view of the FIG. 9 tool;

FIG. 12 is a bottom plan view of the FIG. 9 tool;

FIG. 13 is a front end view of the FIG. 9 tool further illustrating the placement of the overlapped insert elements, one being a sharpened carbide sharpening/deburring element and the other being an unsharpened steel blade guide element; and FIG. 14 is a rear end view of the FIG. 9 tool further illustrating the rear extension in relation to the overlapped insert elements.

DETAILED DESCRIPTION OF THE INVENTION

Figure 5:
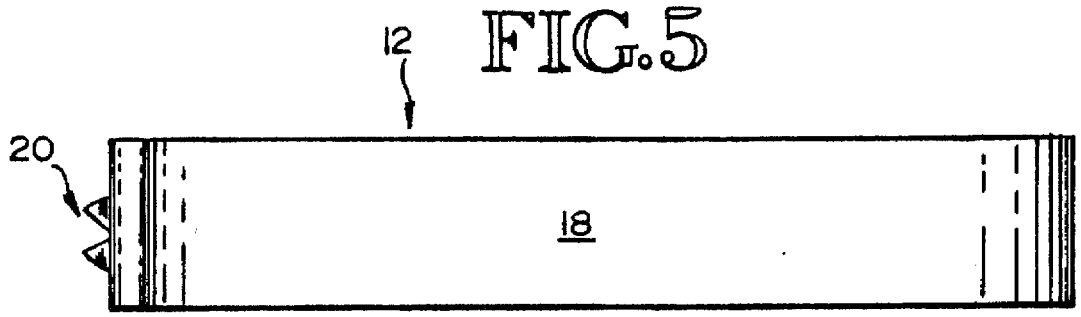
FIG. 5 is a top plan view of the FIG. 1 tool.
Figure 6:
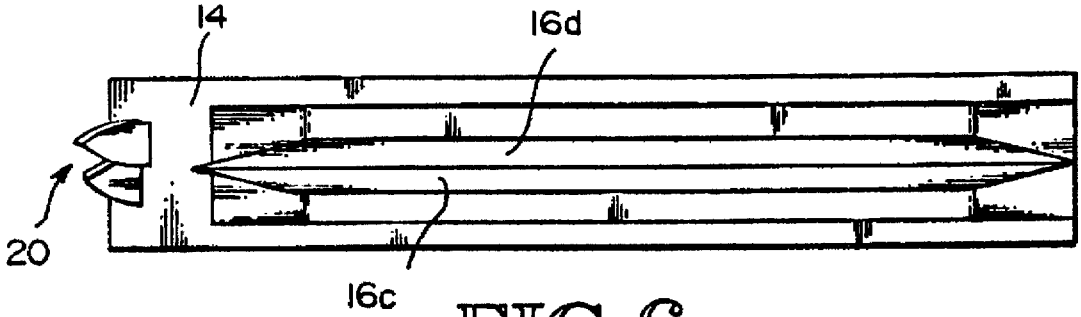
FIG. 6 is a bottom plan view of the FIG. 1 tool.

The tool of this invention preferably comprises a unitary body having a front end section mounting a sharpening means, and a main section incorporating handle means and hand guard means. In the preferred form of the tool body, the body provides a ring section that incorporates the handle means and the hand guard means. The preferred one-piece construction of the tool provides a relatively stiff and inflexible handle and hand/finger guard within the ring configuration The tool body is provided with recesses in a first frontal section thereof to receive one or more sharpening and/or deburring inserts and a second section located longitudinally rearwardly of the first frontal section. The recesses are adapted to receive a first insert member in a generally transverse position with respect to the longitudinal axis of the body, and to receive a second insert member in a generally transverse position with respect to the longitudinal axis of the body. A plurality of sharpening and/or deburring insert members are positioned within the body recesses. These insert members comprise first and second insert members. The first insert member, having a ground surface providing at least one sharpening and/or deburring edge, is positioned within the body recesses such that its ground surface is oriented toward the outer end of the frontal section at an obtuse angle with respect to the longitudinal axis of the body, the second insert member, having an edge complementary to the first insert's ground-surfaced edge, is positioned within the body recesses such that it partially overlays the second insert member in abutting contact therewith and such that its complementary is oriented at an obtuse angle with respect to the longitudinal axis of the body. The second insert's complementary edge may be provided with a ground surface, in which case the tool would be adapted to sharpen/deburr V-shaped blades such as knife blades that must be sharpened on two sides. Alternately, the second insert's complementary edge may be provided with an unground surface, in which case the tool would be adapted to sharpen/deburr single-edged blades such as scissors blades, most garden tools, pruners and shears, and the like, which must be sharpened on one side only. The edges of the first and second insert members are convergent whereby an object to be sharpened or deburred may be inserted between their convergent surfaces for sharpening and/or deburring.

Insert retaining means may be detachably secured to the body and adapted to contact one of the insert members and to apply a sufficient force to that insert member whereby the first and second insert members are restrained from movement within the body recesses. However, it is preferred to incorporate the insert members integrally into the body so that separate insert retaining means are unnecessary.

The hand held sharpening/deburring tool 10 of the first embodiment of this invention, as depicted in FIGS. 1–8, comprises (a) a unitary body 12 having a hand/finger guard section 14, a blade guide section 16, and a handle grip section 18; and (b) sharpening/deburring insert members 20 fastened to the body 12. The front end section 22 of body 12 mounts the insert members 16 and also provides a thumb rest 24 above the insert mounting. Thus, the insert mounting and the thumb rest are located forwardly of the handle grip section 18, the blade guide section 16, and the hand/finger guard section 14.

Figure 8:
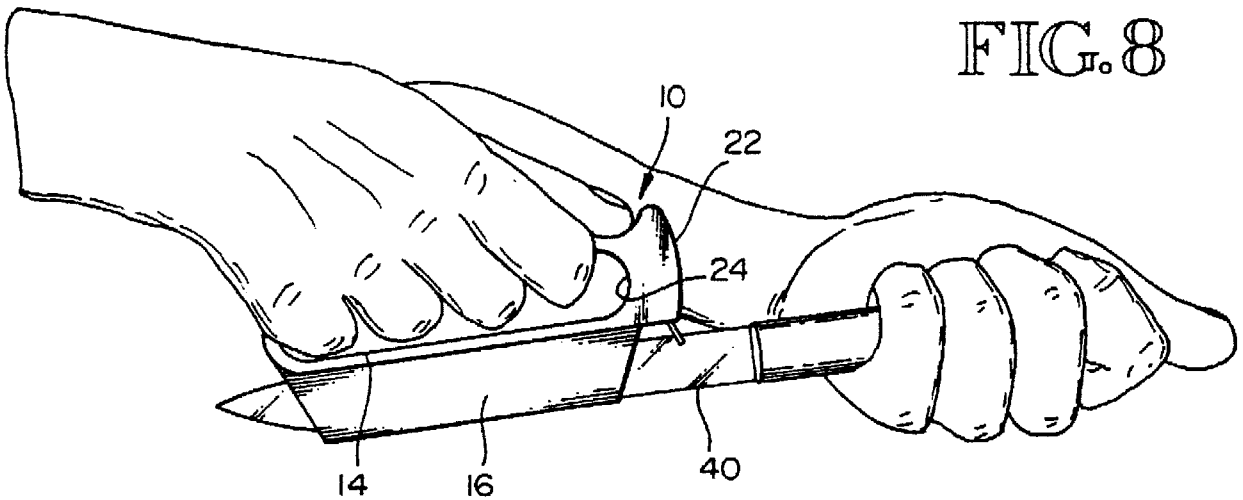
FIG. 8 is a perspective view of the FIG. 1 tool illustrating its use in sharpening a knife blade with the tool applied to the knife blade with the blade tracking in the blade guide.
Figure 7:
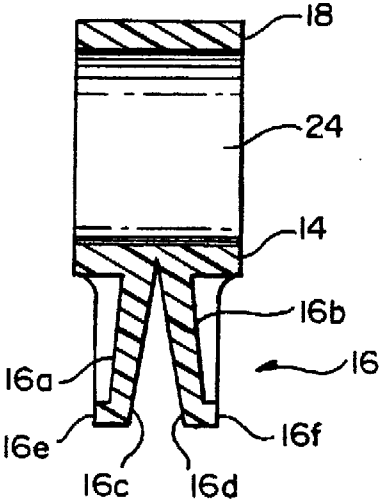
FIG. 7 is a cross-section view taken along the line 8—8 of FIG. 2.

The main part of the body 12 is formed as a flattened ring, longitudinally elongated. The upper part of this flattened ring provides the handle grip section 18 and the bottom part provides the hand/finger guard section 14. The handle grip section 18 and the hand/finger guard section 14 are generally rectangular in cross-section as can be seen in FIG. 7. The interior 24 of this flattened ring is long enough and high enough to accommodate a user's fingers when the user wraps his/her fingers around the upper part in a gripping fashion. Gripping the ring thusly naturally places the user's thumb on the thumb rest 24, and the bottom part naturally forms the finger/hand guard as can be seen in FIG. 8.

The blade guide section 16, of this first embodiment, depends from the finger/hand guard section 14. Section 16 comprises a pair of depending walls **16*a*, 16*b* that have interior, facing surfaces 16*c*, 16*d* that are upwardly convergent (i.e. surfaces 16*c*, 16*d* are inverted V-shaped in cross-section as can be seen in FIG. 7). The periphery of each wall, 16*a*, 16*b*, is rimmed with an laterally-outward extending reinforcing edge, 16*e*, 16*f*, and the walls consist of webs extending between the finger/hand guard 14 and the reinforcing edges 16*e* (in the case of wall 16*a*), 16*f* (in the case of wall 16*b***).

The sharpening/deburring inserts 20, of this first embodiment, are rectangularly shaped flat members made of appropriate material such as tungsten carbide or the like. Each blade has a ground face to be employed in a sharpening/deburring process. With respect to inserts 20 the ground faces are intersected and overlayed as shown to provide convergent sharpening/deburring working edges that define a V-shaped notch. The ground faces of inserts 20 may be beveled at about 5 degrees so that the faces themselves lie in convergent planes. Therefore, the cutting edge of a knife or like device may be rested upon the working edges of inserts 20 and tool 10 drawn therealong to sharpen or deburr the cutting edge. The outside front corners of inserts 20 may be rounded as shown in FIG. 3.

The inserts 20 are received in overlying abutting relationship and held in such relationship as a result of being secured within the body 12. This may be accomplished by molding the body 12 around the inserts or by fastening the inserts into a slot provided in the body 12. If it is desired to make the inserts replaceable, the front end section 22 could be appropriately modified to accommodate an insert retainer that would detachably secure the inserts to the front end section 22. Such an insert retainer could be formed to position and hold the inserts 20 in the proper overlapped and aligned position shown in the drawings.

When in use, the tool 10, of the first embodiment, is placed over a blade, such as knife blade 40 in FIG. 8, with the webs **16*a*, 16*b* of the blade guard 16 disposed on either side of the blade 40. As can be seen in FIG. 4, the inverted V-shaped notch of the blade guide will guide the blade edge into the proper relationship with the inserts 20 for sharpening/deburring. The V-shaped notch, defined by the inner surfaces 16*c*, 16*d* of the webs 16*a*, 16*b*, is longitudinally elongated, underlying and extending substantially the full length of the flattened ring of body 12. The bottom of the notch is located at the base of the finger/hand guard 14 so that the knife blade edge will be guided longitudinally through the sharpening/deburring inserts 20, just below the finger/hand guard 14. The inserts 20 extend forwardly and outwardly at an obtuse angle from the front end section 22 so that they will form an acute angle with respect to the blade edge to be sharpened/deburred, also as shown in FIG. 8. In operation, the blade being sharpened/deburred is shielded from the user's hand and, when the tool is pulled beyond the tip of the blade, the front end section 22** continues to shield the user's knuckles and thumb.

A preferred tool 10, of the first embodiment, is fabricated from injection-molded plastic, with a width of about 0.75 in., a length of about 4.24 in. and a height of about 2 in. The inverted V-shaped notch of the blade guide has a depth of about 0.75 in. The thickness of the rim of the flattened ring is about ⅛ in. and the thickness of the blade guide webs is also about ⅛ in.

The hand held sharpening/deburring tool 110 of the second embodiment of this invention, as depicted in FIGS. 9–14, comprises (a) a unitary body 112 having a hand/finger guard section 114, a handle grip section 118, and a rear extension section 119; and (b) sharpening/deburring insert members 120 fastened to the body 112. The front end section 122 of body 112 mounts the insert members 120 and also provides a thumb rest 124 above the insert mounting. Thus, the insert mounting and the thumb rest are located forwardly of the handle grip section 118 and the hand/finger guard section 114.

The main part of the body 112 is formed as a flattened ring, longitudinally elongated. The upper part of this flattened ring provides the handle grip section 118 and the bottom part provides the hand/finger guard section 114. The handle grip section 118 and the hand/finger guard section 114 are generally rectangular in cross-section similar to the configuration depicted in FIG. 7 with respect to the first embodiment. The interior 124 of this flattened ring is long enough and high enough to accommodate a user's fingers when the user wraps his/her fingers around the upper part in a gripping fashion. The upper surface of the body 112 is concave along the front end section 122, to provide a depression to accommodate a user's thumb, and is convex along the handle grip section 118. The bottom surface of the body 112 is flat from the front end to the rear end of the hand/finger guard section 114.

Gripping the ring naturally places the user's thumb on the thumb rest 124, and the bottom part naturally forms the finger/hand guard, similar to that shown in FIG. 8 with respect to the first embodiment. However, the flattened ring portion of the body 112 in this second embodiment may be configured so that the longitudinal length of the interior 124 may conveniently accommodate only a user's three fingers, rather than a user's four fingers as shown in FIG. 8. In order to accommodate a user's fourth finger, the little finger, this second embodiment provides an unitary rear extension 119 that extends rearwardly of the ring portion. This extension 119 has a width similar to the width of the handle grip section 118 and the hand/finger guard section 114. The top surface of the rear extension 119 extends rearwardly tangent to the convex curvature of the upper surface of the handle grip section 118. The bottom surface of the rear extension 119 extends in a convex arc from the flat bottom surface of the hand/finger guard section 114 into a concave arc 119*a*, with the terminal end 119*b* of the rear extension 119 extending rearward in tangent to that concave arc also. This configuration of the rear extension 119 enables a user to place his or her little finger either on top of the terminal end 119*b* of the rear extension or underneath the terminal end, in the region of the concave arc 119*a*. Also, the terminal end 119*b* may be provided with an attachment hole 119*c* so that the tool may be attached to a cord or chain looped through hole 119*c*, or so that the tool may be attached to a nail or hook inserted through hole 119*c* for storage.

The sharpening/deburring inserts 120, of this first embodiment, are rectangularly shaped flat members made of appropriate material, one insert 120*a* being fabricated from a material such as tungsten carbide or the like, and the other insert 120*b* being fabricated from a material such a steel or the like. Insert 120*a* has a ground face to be employed in a sharpening/deburring process. Insert 120*b* has an unsharpened face complementary to the ground face of insert 120*a* to provide a guide surface for a scissors blade or a like blade. With respect to inserts 120 the faces are intersected and overlayed as shown to provide convergent edges that define a V-shaped notch, one such surface on insert 120*a* being a working edge for sharpening/deburring the beveled aspect of a scissors-type blade, and the other such surface on insert 120*b* being a guide edge to position a scissors-type blade in proper position relative to insert 120*a*. The faces of inserts 120 may be beveled at about 5 degrees so that the faces themselves lie in convergent planes. Therefore, the cutting edge of a scissors or like device may be rested upon the working edges of inserts 120 and tool 110 drawn therealong to sharpen or deburr the cutting edge. The outside front corner of insert 120*a* may be rounded as shown in FIG. 13. The front corners of insert 120*a* could be eased, as opposed to being rounded, and the front end of insert 120*b* preferably protrudes beyond the front end of insert 120*a* to shield the sharp inside front corner of insert 120*a*, as shown in FIGS. 13 and 14.

The inserts 120 are received in overlying abutting relationship and held in such relationship as a result of being secured within the body 112. This may be accomplished by molding the body 112 around the inserts or by fastening the inserts into a slot provided in the body 112. If it is desired to make the inserts replaceable, the front end section 122 could be appropriately modified to accommodate an insert retainer that would detachably secure the inserts to the front end section 122. Such an insert retainer could be formed to position and hold the inserts 120 in the proper overlapped and aligned position shown in the drawings.

When in use, the tool 110, of the second embodiment, is placed over a scissors-type blade, such as shown in FIG. 9. The inserts 120 extend forwardly and outwardly at an obtuse angle from the front end section 122 so that they will form an acute angle with respect to the blade edge to be sharpened/deburred. In operation, the blade being sharpened/deburred is shielded from the user's hand by the base 114*a*, or underside, of the hand/finger guard section 114 and, when the tool is pulled beyond the tip of the blade, the front end section 22 continues to shield the user's knuckles and thumb. The base 114*a* provides a flat, linear surface that extends from the nose 122*a* of the front section 122 to the rear extension 119.

Because of the one-piece construction and ring configuration, the hand/finger guard section 114 is relatively rigid and inflexible. The base 114*a*, extending substantially the full length of the tool, excepting the rear extension 119, provides a solid, inflexible barrier between a user's hand/fingers and the blade to be sharpened. Moreover, because the base 114*a* extends from the nose 122*a* of the front section 122 to the rear extension 119, the tool can be placed on a blade to be sharpened with the base 114*a* in contact with the blade as the tool is drawn along the blade during the sharpening process without endangering the user's hand/fingers. Consequently, a user will feel more secure in using this tool compared to using a tool of the prior art type which employs a flexible hand/finger guard that might flex or bend if contacted by the blade during a sharpening process.

A preferred tool 110, of the second embodiment, is fabricated from injection-molded plastic, with a width of about 0.50 in., a length of about 4.25 in. and a height of about 1.25 in. The thickness of the rim of the flattened ring is about ⅛ in. The interior 124 of the flattened ring is about 2.5 in. long by about 1.0 in. high.

In both the first and second embodiments heretofore described, the front end section 22, 122 is bounded by a rib and the center portion so bounded is filled with a web. The rib 22*b*, 122*b* is about ⅛ in. thick and the center portion 22*c*, 122*c* is about ¼ in. thick. The center portion 22*c*, 122*c* is aligned along the center line of the tool 10, 110 so that there is a recess on each side of the web about ⅛ in. deep. The wall of the front end section 22, 122 adjacent to the inserts 20, 120 is thicker than the boundary rib 22*b*, 122*b* so that there is sufficient material surrounding the embedded portions of the inserts 20, 120 to hold them firmly in place. With respect to the second embodiment 110, the body is provided with a recess 110*a* between the rear end of the ring interior 124 so that the surrounding material is about ⅛ in. thick; and a web 110*b* about ¼ in. thick is centered within the recess with the recess being about ⅛ in. deep on each side of the web.

While the preferred embodiments of the invention have been described herein, variations in the design may be made. The scope of the invention, therefore, is only to be limited by the claims appended hereto.

The embodiments of the invention in which an exclusive property is claimed are defined as follows:

1. A hand-held sharpener tool for sharpening blades which comprises a one piece body having first and second sections; sharpening means mounted in said first section; said second section being located rearwardly of said sharpening means and comprising an elongated handle on an upper side of said body extending rearwardly of said first section, and an elongated hand guard on a lower side of said body extending rearwardly of said first section; said body being so constructed and arranged that said handle and said blade hand guard are rigid and integrally joined together at respective rear ends thereof to form a ring that incorporates both said handle and said hand guard so that a user's fingers may be extended through said ring to grip said handle and may be shielded by said hand guard; said body being further so constructed and arranged that said body is flattened and elongated to provide a ring interior having a length and height sufficient to accommodate several fingers of a user's hand when a user grips said handle and to provide a straight blade guard that extends from a nose portion of said front section and along the base of ring.

2. The tool of claim 1 wherein said body is provided with an integral flat surface that extends from a nose portion of said front section and along the base of said hand guard, said front section and said hand guard being so constructed that said flat surface is relatively stiff and inflexible when a blade to be sharpened is contacted with said flat surface during a sharpening process.

3. The tool of claim 2 wherein said sharpening means comprises first and second insert members mounted so as to protrude from said flat surface adjacent to said nose portion, the first insert member being provided with a sharpening/deburring edge, and the second insert member being provided with a complementary edge partially overlaying said sharpening/deburring edge so as to form therewith a V-shaped notch so that said tool may sharpen and deburr a single-sided blade edge.

4. The tool of claim 3 wherein said body includes an integral rear extension extending from a rearward most portion of said ring having a length sufficient to provide a finger rest for a user's little finger that extends rearwardly of said ring.

5. The tool of claim 4 wherein said rear extension is provided with a hole for attaching said tool to another object for storage.

6. The tool of claim 4 wherein said rear extension has an upper surface configured to have a user's little finger rested thereon during use of said tool.

7. The tool of claim 1 wherein said body includes an integral rear extension extending from a rearward most portion of said ring having a length sufficient to provide a finger rest for a user's little finger that extends rearwardly of said ring.

8. The tool of claim 1 wherein said sharpening means comprises first and second insert members, the first insert member being provided with a sharpening/deburring edge, and the second insert member being provided with a complementary edge partially overlaying said sharpening/deburring edge so as to form therewith a V-shaped notch so that said tool may sharpen and deburr a single-sided blade edge.

* * * * *